US011585647B2

(12) United States Patent
Fitzgerald

(10) Patent No.: US 11,585,647 B2
(45) Date of Patent: Feb. 21, 2023

(54) LOW DENSITY BLASTING MAT AND METHOD OF UTILIZING SAME

(71) Applicant: B2B Industrial Inc., Sturgeon Falls (CA)

(72) Inventor: Kevin James Fitzgerald, Copper Cliff (CA)

(73) Assignee: B2B Industrial Inc., Ontario (CA)

( * ) Notice: Subject to any disclaimer, the term of this patent is extended or adjusted under 35 U.S.C. 154(b) by 0 days.

(21) Appl. No.: 17/407,327

(22) Filed: Aug. 20, 2021

(65) Prior Publication Data

US 2022/0057184 A1 Feb. 24, 2022

Related U.S. Application Data

(60) Provisional application No. 63/067,914, filed on Aug. 20, 2020.

(51) Int. Cl.
*F42D 5/05* (2006.01)
*E02D 5/80* (2006.01)

(52) U.S. Cl.
CPC ..... *F42D 5/05* (2013.01); *E02D 5/806* (2013.01)

(58) Field of Classification Search
CPC ..... F42D 5/05
USPC ..... 102/303; 86/50
See application file for complete search history.

(56) References Cited

U.S. PATENT DOCUMENTS 2,474,904 A 7/1949 Mazzella
2,474,905 A 7/1949 Mazzella
2,699,803 A 1/1955 Mazzella
2,926,605 A 3/1960 Hammel, Jr. et al.
3,371,604 A 3/1968 Per Folke Wikner et al.
3,648,613 A * 3/1972 Cunn ..... F42D 5/05 102/303
3,793,953 A 2/1974 Lewis
3,945,319 A 3/1976 Meagher
4,326,668 A 4/1982 Granryd
4,399,954 A * 8/1983 Arrant ..... E01C 13/08 242/615
4,407,606 A 10/1983 Larsen
4,780,351 A * 10/1988 Czempoyesh ..... F42D 5/05 428/196
4,998,670 A 3/1991 Peterson
5,364,206 A 11/1994 Marienfeld
(Continued)

FOREIGN PATENT DOCUMENTS

JP S62198400 U * 12/1987
RU 2314419 C1 1/2008
RU 2717323 C1 3/2020

OTHER PUBLICATIONS

Machine-Generated English Language Translation of RU2314419.
Machine-Generated English Language Translation of RU2717323.

*Primary Examiner* — Bret Hayes

(57) ABSTRACT

A mat assembly including a planar mat body formed to cover a preselected area of a surface region. The preselected area partially defines a volume of ground to be broken by explosion therein. The mat body includes one or more layer elements. The mat body has an engagement surface for engagement with the preselected area. The mat assembly includes a skirt element connected with the mat body having an external portion extending from the mat body, for at least partially restraining matter ejected from the volume of ground upon initiation of the explosion.

3 Claims, 13 Drawing Sheets

(56) References Cited

U.S. PATENT DOCUMENTS

| | | | | |
|---|---|---|---|---|
| 5,482,754 | A | 1/1996 | Crook | |
| 6,080,460 | A | 6/2000 | Chapman | |
| D484,647 | S | 12/2003 | Casey | |
| 10,655,940 | B2 * | 5/2020 | Li | B32B 5/12 |
| 10,739,121 | B2 | 8/2020 | Fitzgerald et al. | |
| 2005/0089377 | A1 | 4/2005 | Allen | |
| 2008/0152436 | A1 | 6/2008 | Torres Vila | |
| 2011/0280671 | A1 | 11/2011 | Merrill | |
| 2013/0078041 | A1 | 3/2013 | Price | |
| 2013/0259568 | A1 | 10/2013 | Bouchard | |
| 2016/0040962 | A1 * | 2/2016 | Rossow | F41H 5/0485 89/36.02 |
| 2018/0112963 | A1 * | 4/2018 | Nzengung | F42D 5/05 |
| 2019/0382246 | A1 | 12/2019 | Bryan et al. | |
| 2020/0398612 | A1 | 12/2020 | Joyce | |

* cited by examiner

LOW DENSITY BLASTING MAT AND METHOD OF UTILIZING SAME

CROSS-REFERENCE TO RELATED APPLICATION

This application claims the benefit of U.S. Provisional Application No. 63/067,914, filed on Aug. 20, 2020, and incorporates such provisional application in its entirety by reference.

FIELD OF THE INVENTION

The present invention is a low density blasting mat and a method of utilizing the blasting mat.

BACKGROUND OF THE INVENTION

In the prior art, blasting mats are typically designed to have the greatest area density possible, taking into account the materials used and other practical constraints. This is because until recently all the explosives used (e.g., ANFO (ammonia nitrate and fuel oil)) in commercial blasting operations are high-velocity explosives, for which a higher-density blasting mat is required in order to achieve an acceptable degree of containment of the matter (gases, dust, and flyrock) ejected from the ground (i.e., rock) that is broken by a high-velocity explosive blast.

The conventional blasting mats are available in a number of sizes, e.g., 20 feet by 20 feet (400 square feet). Typically, the conventional high-density blasting mats are made of pieces of used rubber tires that are held together by steel cables that have been passed through the pieces. The steel cables are used also to keep the pieces compressed, to maintain the high density that is thought to be desirable.

As is well known in the art, the conventional high-density blasting mats have a number of disadvantages. First, due to their relatively high area densities (e.g., usually about 18 kg per square foot (39.7 lbs per square foot)), the conventional blasting mats are difficult to handle at the site, and they are also expensive to ship over long distances. Second, the conventional blasting mats are bulky, and this also makes their shipping difficult, and relatively expensive.

In practice, the conventional blasting mats are often overlain with each other, in order to ensure comprehensive coverage over an entire blast pattern. However, the extent of the overlap is significant, e.g., two to three feet at each end of each mat. Because of the overlap, a greater number of conventional blasting mats are required than would otherwise be needed, in the absence of the overlap.

SUMMARY OF THE INVENTION

For the foregoing reasons, there is a need for a blasting mat that overcomes or mitigates one of more of the defects and disadvantages of the prior art.

In its broad aspect, the invention provides a mat body to be positioned on a surface region. The mat body includes one or more layer elements having one or more abrasion-resistant surfaces. The layer element(s) may include a core of high-strength material, and the abrasion-resistant surface may be provided by a coating over part of the core.

In another of its aspects, the invention provides a mat assembly formed to be positioned relative to a preselected area of the surface region. The preselected area partially defines a volume of ground to be broken by explosion therein. The mat assembly includes the mat body formed to cover the preselected area, and a skirt element connected with the mat body. The skirt element includes an external portion extending from the mat body for at least partially restraining matter ejected from the volume of ground, upon initiation of the explosion.

BRIEF DESCRIPTION OF THE DRAWINGS

The invention will be better understood with reference to the attached drawings, in which.

DETAILED DESCRIPTION

Figure 1A:
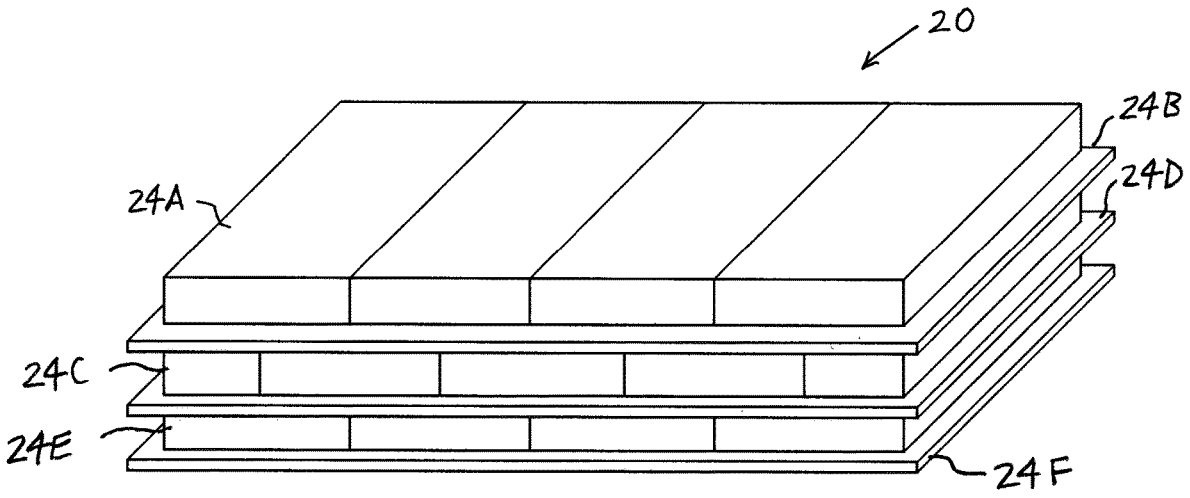
FIG. 1A is an isometric view of an embodiment of a mat body of the invention.

In the attached drawings, like reference numerals designate corresponding elements throughout. Reference is first made to FIGS. 1A-1E to describe an embodiment of a mat body in accordance with the invention indicated generally by the numeral 20.

Figure 1B:
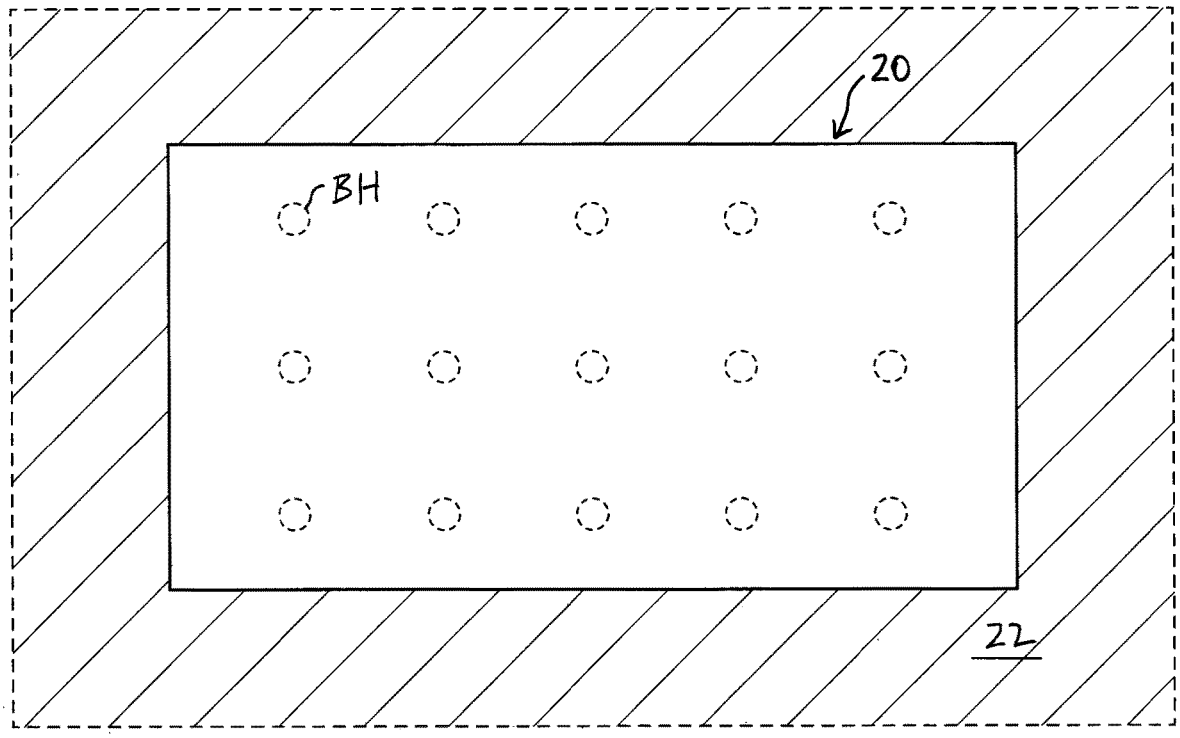
FIG. 1B is a top view of the mat body of FIG. 1A positioned on a preselected area of a surface region, drawn at a smaller scale.
Figure 1C:
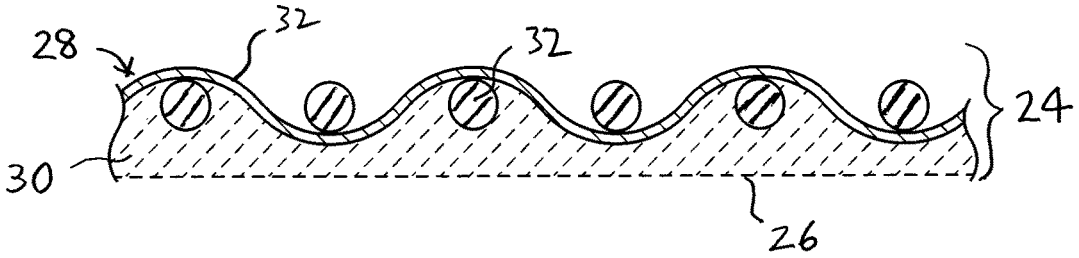
FIG. 1C is a cross-section of a layer element of the mat body of FIGS. 1A and 1B, drawn at a larger scale.
Figure 1D:
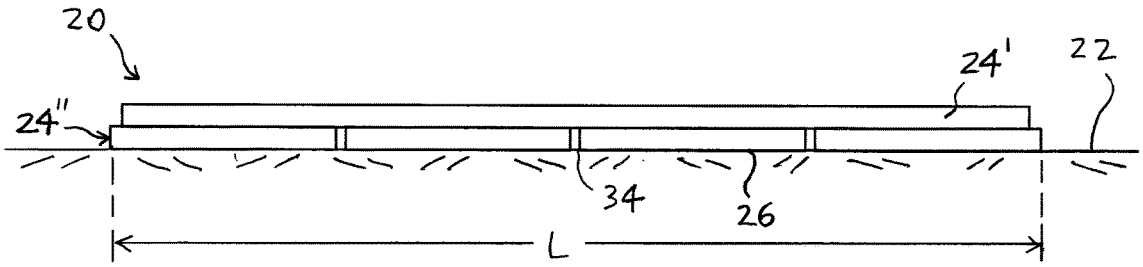
FIG. 1D is a side view of another embodiment of the mat body positioned on the preselected area of the surface region, drawn at a smaller scale.

As will be described, the mat body 20 is formed to be positioned on a surface region 22 (FIGS. 1B, 1D). Preferably, the mat body 20 includes one or more layer elements 24, the layer elements 24 including one or more abrasion-resistant surfaces 26. In one embodiment, the mat body 20 preferably has an area density up to 2.2 pounds per square foot.

The layer elements 24 may be made of any suitable materials. As will also be described, it is preferred that the layer element 24 includes a core 28 of high-strength material and a coating 30 that provides the abrasion-resistant surface 26.

In recent years, low-velocity explosives (e.g., Autostem™) have become available for commercial blasting applications. The inventor has determined that blasting mats with reduced area density may be used to provide adequate protection, where low-velocity explosives are used.

A volume of ground (e.g., rock) is drilled with several holes, in a drill pattern, over a preselected area 34 of the surface region 22 that partially defines the volume of ground to be broken by explosion therein. For clarity of illustration, the holes in the blast pattern are identified by reference character "BH" in FIG. 1B. The low-velocity explosives are then positioned in the drilled holes "BH". The velocity of the matter (e.g., gases, dust, and flyrock) thrown outwardly from the preselected area when the low-velocity explosives are detonated is less than the velocity thereof if high-velocity explosives were utilized instead. However, even when using low-velocity explosives, such matter is ejected from the volume of ground that is broken by the explosion. Accordingly, the low density mat body is intended to at least partially restrain such matter, which is ejected from the preselected area virtually instantaneously upon initiation of the explosion.

As noted above, the maximum area density of the mat body may be 2.2 pounds per square foot, or less. This compares well with a typical area density of the conventional blasting mat of about 39.7 pounds per square foot, and there are a number of advantages that result from using the lightweight mat body 20, as will be described.

As illustrated in FIG. 1A for exemplary purposes, the mat body 20 may include several layer elements 24, which may be made of different materials. The layer elements in FIG. 1A are identified by reference characters 24A-24F for clarity of illustration. Also, the layer elements 24B, 24D, and 24F are shown as extending outwardly past the other layer elements (to which they are adjacent) for clarity of illustration.

Although the layer elements 24 may be made of any suitable material or materials, it is preferred that composite materials and/or plastics are used, because they can provide sufficient strength and an advantageous low area density that may be used to at least partially contain matter ejected from an explosion of low-velocity explosives. Depending on the material used to form the layer element(s) 24, the layer element(s) 24 may be very thin and compact, which is advantageous because the mat is easy to handle at the site, and the shipping costs of the mat body 20 are reduced, as compared to the conventional blasting mats. It will be understood that, where there is more than one layer element 24 in the mat body 20, the layer elements 24 may be positioned relative to each other and secured to each other in any suitable manner.

For example, as illustrated in FIG. 1C, the layer element 24 may include fibers 32 of a suitable material that form the core 28. The layer element 24 may also include the coating 30 that may cover one or more sides of the core 28. The fibers 32 may be any suitable fibers, e.g., carbon fibers, Kevlar™ fibers, basalt fibers, or fiberglass fibers. As indicated in FIG. 1C, in one embodiment, the fibers 32 may be woven together before the coating 30 is applied thereto.

The coating 30 may be any suitable coating that provides strength to the layer element. The coating 30 may be an abrasion-resistant coating providing the abrasion-resistant surface 26, e.g., if the layer element 24 is formed to engage the surface region 22. For example, the coating 30 may be a suitable polyurethane coating. Preferably, the abrasion-resistant surface 26 is positioned in the mat body 20 so that the surface 26 may be located adjacent to, and at least partially engaged with, the preselected area 34.

It will be understood that the mat body 20 may have a relatively low area density because of the materials selected to be included in the mat body 20. The mat body 20 may be formed using no compression, or minimal compression, of the elements included in the mat body 20.

Figure 1E:
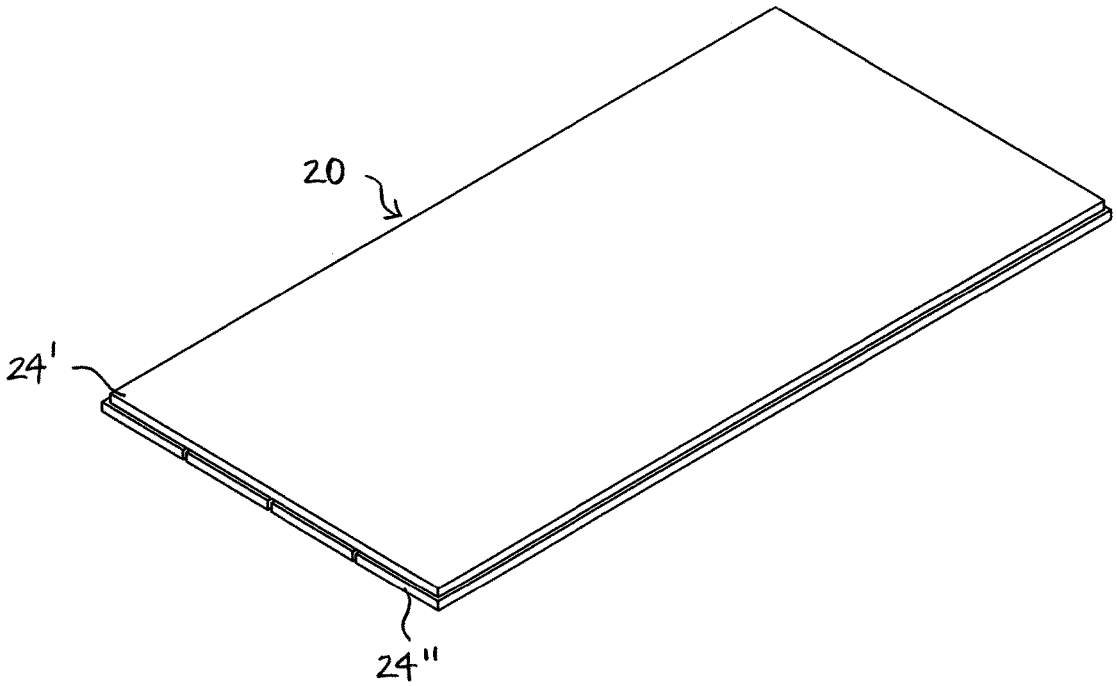
FIG. 1E is an isometric view of the mat body of FIG. 1D, drawn at a smaller scale.

As noted above, the mat body 20 may include one or more layer elements 24. In FIGS. 1D and 1E, the embodiment of the mat body 20 illustrated therein includes two layer elements, identified therein for convenience by reference characters 24' and 24".

In one embodiment, the mat body 20 is positioned so that its edges are congruent with the perimeter of the preselected area 34. This can be seen in FIGS. 1B and 1D. It will be understood that although the preselected area 34 as illustrated is generally rectangular in outline, the preselected area 34 may have any suitable form or shape. In FIG. 1D, the reference character "L" designates a length of one side of the preselected area 34. It can be seen in FIG. 1D that the abrasion-resistant surface 26 may engage the preselected area 34.

The mat body 20 may be secured by any suitable means, in part, to the surface region 22. For example, the mat body 20, if formed to have corners, may be secured at its corners.

Those skilled in the art would appreciate that the mat body 20 may be used for purposes other than at least partially restraining matter ejected from ground broken by blasting.

The Applicant's invention preferably includes an embodiment of a mat assembly 136 of the invention that is formed to be positioned relative to the preselected area 34 of the surface region 22 (FIGS. 2A-2D). As noted above, the preselected area 34 partially defines a volume of ground to be broken by explosion therein. For instance, low-velocity explosives may be used to break the volume of ground. As illustrated, the preselected area 34 has a length "L" along one side thereof.

In one embodiment, the mat assembly 136 preferably includes a planar mat body 120 formed to cover the preselected area 34. Preferably, the mat body 20 includes one or more layer elements 124 defining an engagement surface 138 (FIGS. 2B, 2D) for engagement with the preselected area 34 (FIG. 2C). The engagement surface 138 may be at least partially planar. It will be understood that any suitable number of layer elements 124 may be included in the mat body 120. As noted above, it is preferred that the layer elements are made of suitably strong and relatively low density materials. The mat body 120 may include a number of layer elements 124, which may be arranged in a number of layers that are secured together by any suitable means.

Figure 2A:
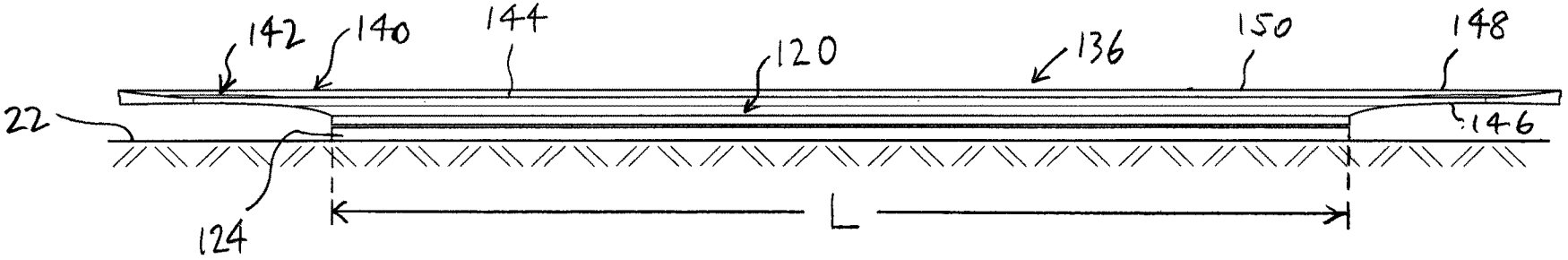
FIG. 2A is a side view of an embodiment of a mat assembly of the invention positioned on the preselected area of the surface region, drawn at a larger scale.
Figure 2B:
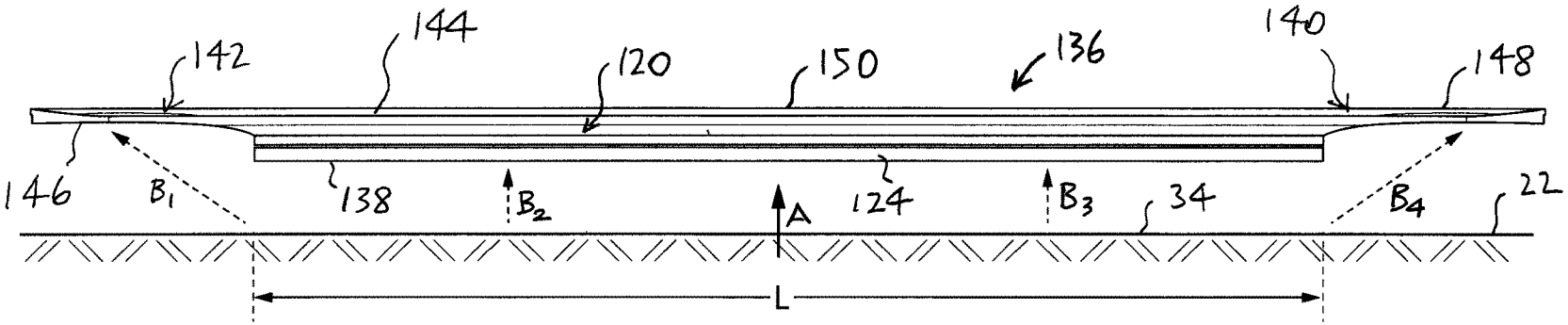
FIG. 2B is another side view of the mat assembly of FIG. 2A.
Figure 2C:
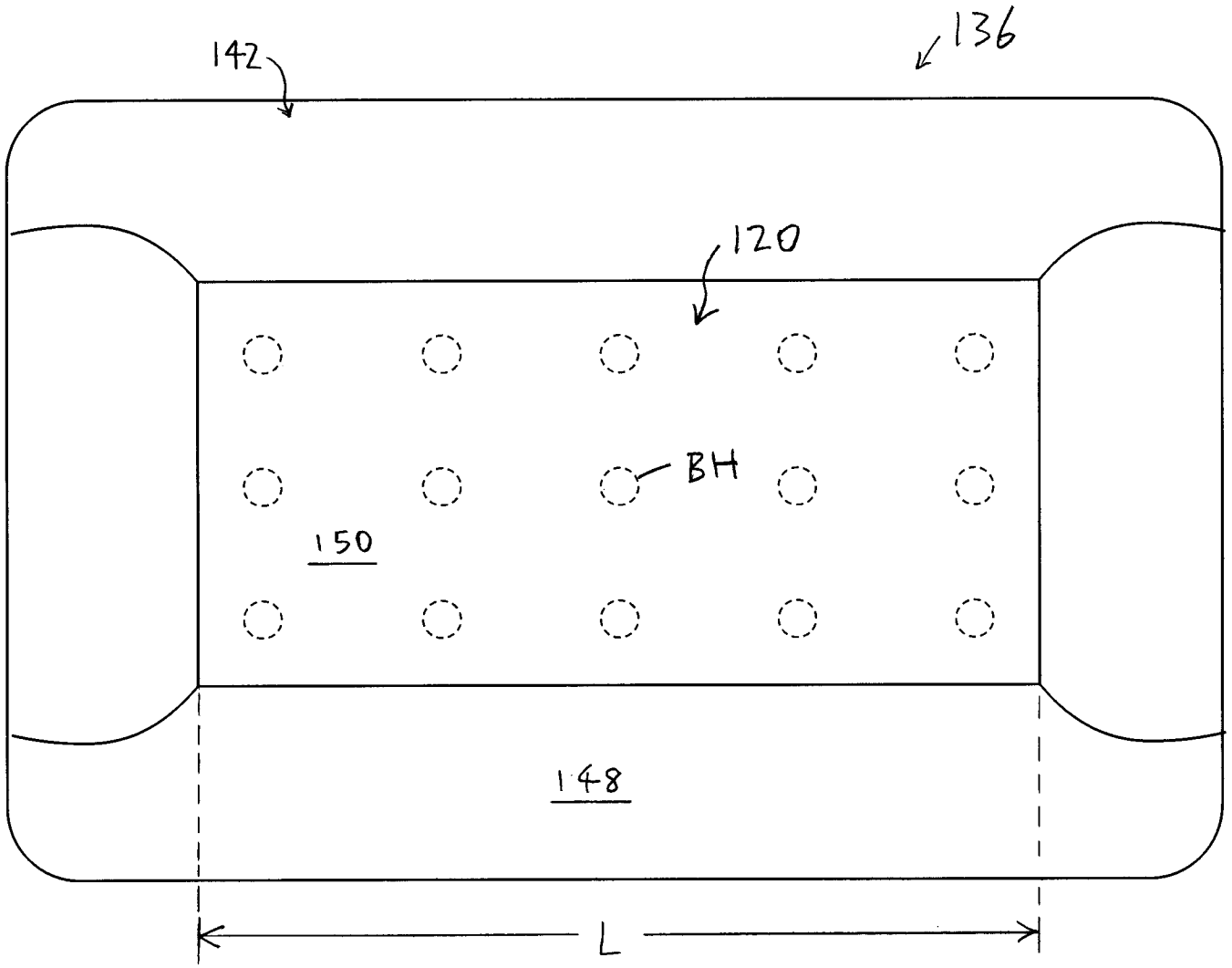
FIG. 2C is a top view of the mat assembly of FIGS. 2A and 2B.
Figure 2D:
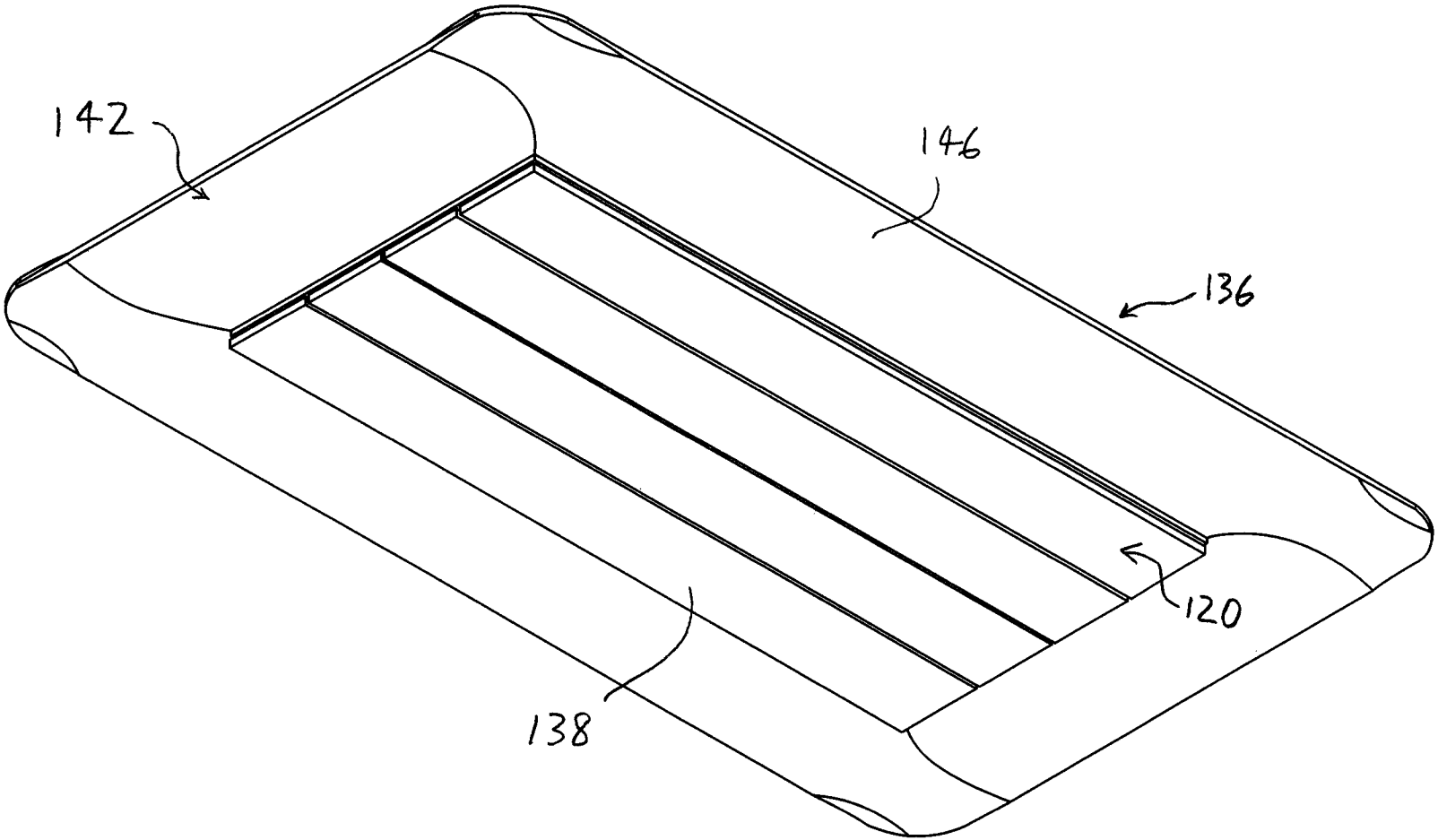
FIG. 2D is an isometric view of the mat assembly of FIGS. 2A-2C.

It is also preferred that the mat assembly 136 includes a skirt element 140 connected with the mat body 120, as will be described (FIGS. 2A, 2B). Preferably, the skirt element 140 includes an external portion 142 extending from the mat body 120, for at least partially restraining matter ejected from the volume of ground, immediately following initiation of the explosion. The skirt element 140 may be at least partially planar.

As can be seen in FIG. 2A, in one embodiment, the external portion 142 preferably is parallel, or substantially parallel, with the engagement surface 138.

It is preferred that the skirt element 140 is partially included in the mat body 120. In one embodiment, the skirt element 140 preferably includes a layer element portion 144 that is connected with one or more of the layer elements located in the mat body 120 (FIG. 2A). Preferably, the layer element portion is secured to the external portion 142.

Those skilled in the art would appreciate that, as the mat assembly 136 is located to position the mat body 120 on the preselected area 34, when the volume of ground below the preselected area is blasted, then matter that is ejected from the volume of ground immediately following the explosion is directed against the engagement surface 138 of the mat body 120, and also against an underside 146 of the external portion 142 (FIG. 2B).

It will be understood that the mat assembly 136 may be moved vertically a small distance off the surface region 22 following the explosion, due to the pressure of gases released by the explosives. Those skilled in the art would appreciate that such movement, if it takes place, occurs immediately after the explosion is initiated. Those skilled in the art would also appreciate that the extent of vertical movement as illustrated in FIG. 2B has been exaggerated, for clarity of illustration.

The mat assembly 136 is shown located on the preselected area 34 in FIG. 2A, prior to initiation of the explosion. As illustrated in FIG. 2B, the mat assembly 136 may be lifted in the direction indicated by arrow "A" off the preselected area, immediately following initiation of the explosion. Those skilled in the art would appreciate that, immediately following the initiation of the explosion, gases, dust and debris, and small pieces of broken rock known as "flyrock" (not shown) may be directed against the mat assembly 136, as schematically indicated by arrows "$B_1$"-"$B_4$" in FIG. 2B. Immediately following the explosion, the flyrock strikes the engagement surface 138 and the underside 146 of the external portion 142, before falling to the ground (i.e., onto the surface region 22, including the preselected area 34).

Figure 3:
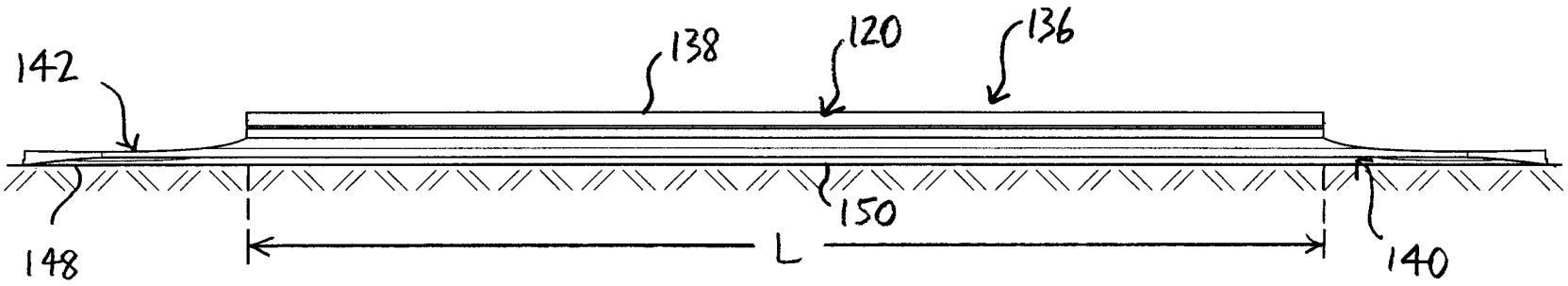
FIG. 3 is a side view of another embodiment of the mat assembly of the invention.

In an alternative embodiment, illustrated in FIG. 3, the external portion 142 preferably is aligned, or substantially aligned, with the engagement surface 138. In the embodiment of the invention illustrated in FIG. 3, the mat assembly 136 is positioned inverted on the surface region 22.

The external portion 142 has an opposed side 148 (FIGS. 2A-2C and 3), opposite to the underside 146. As can be seen in FIGS. 2A-2C and 3, the mat body 120 preferably has a second surface 150 that is opposite to the engagement surface 138 of the mat body 120. The mat assembly 136 may be positioned with the second surface 150 engaging the preselected area 34 (FIG. 3) and with the upper side 148 engaging the surface region 22. Those skilled in the art would appreciate that, in this embodiment, upon initiation of the blast, the matter ejected from the preselected area 34 is primarily directed toward the second surface 150 of the mat body 120, and a portion of the ejected matter is directed toward the upper side 148 of the external portion 142.

It will be understood that, in the embodiment of the invention that is illustrated in FIG. 3, the mat assembly 136 preferably is located to position the mat body 120 over the preselected area 34. Preferably, the mat body 120 illustrated in FIG. 3 is formed to cover the preselected area 34.

Figure 4A:
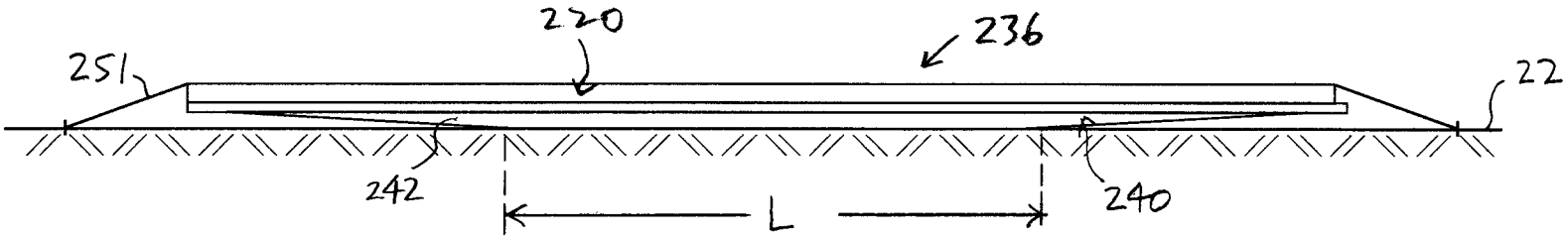
FIG. 4A is a side view of another embodiment of the mat assembly of the invention including an embodiment of a mat body of the invention and a skirt element secured thereto in a retracted condition, positioned on a preselected area.
Figure 4B:
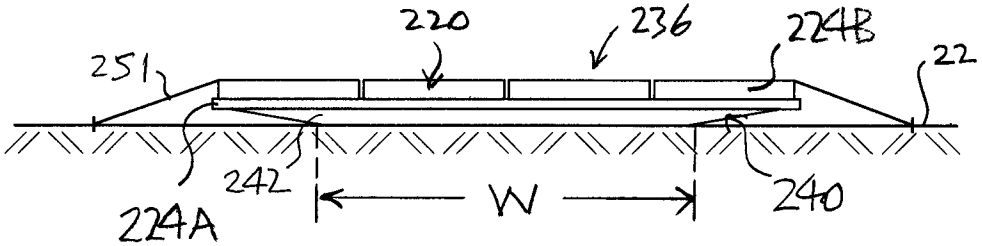
FIG. 4B is another side view of the mat assembly of FIG. 4A.
Figure 4C:
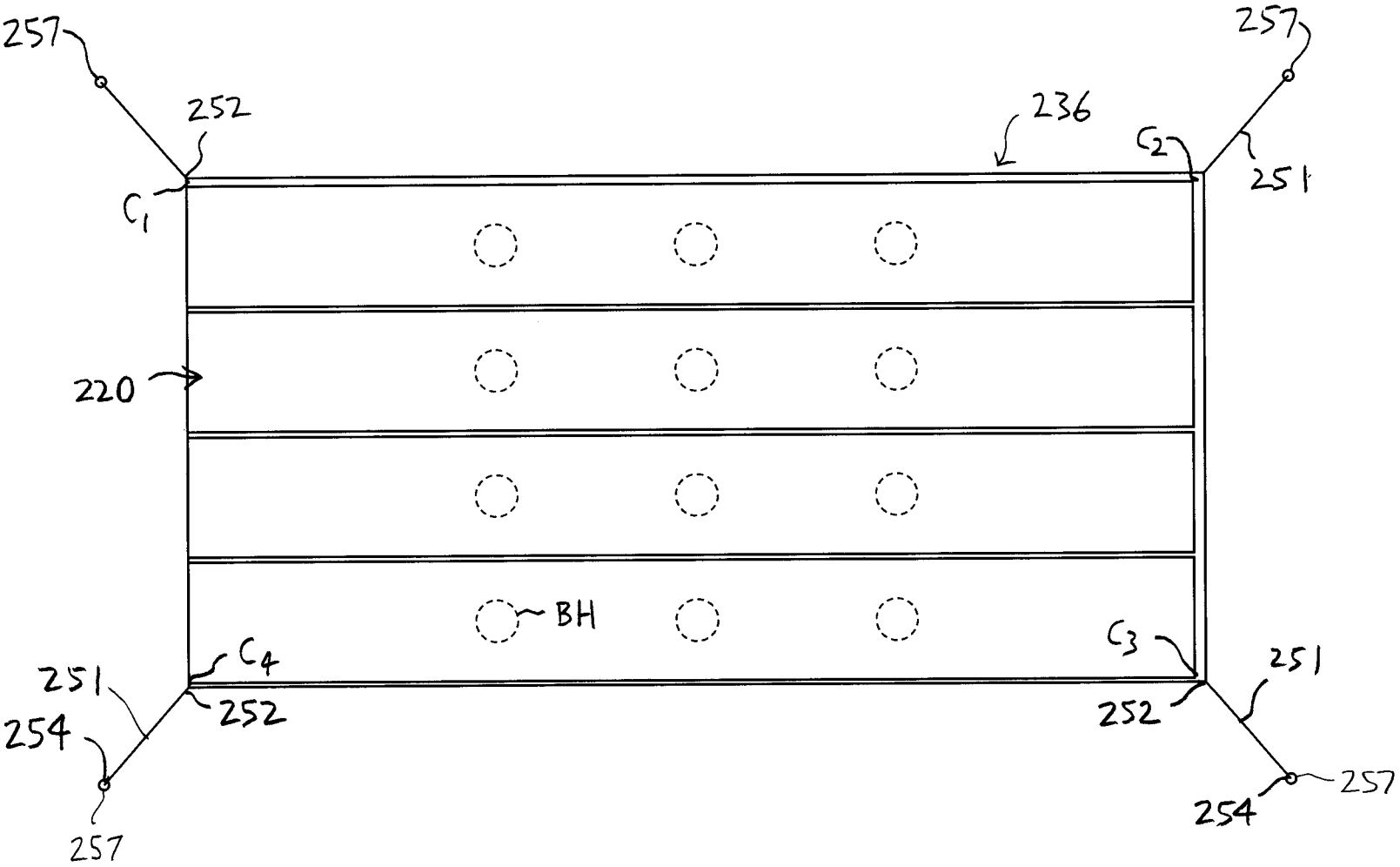
FIG. 4C is a top view of the mat assembly of FIGS. 4A and 4B.
Figure 5A:
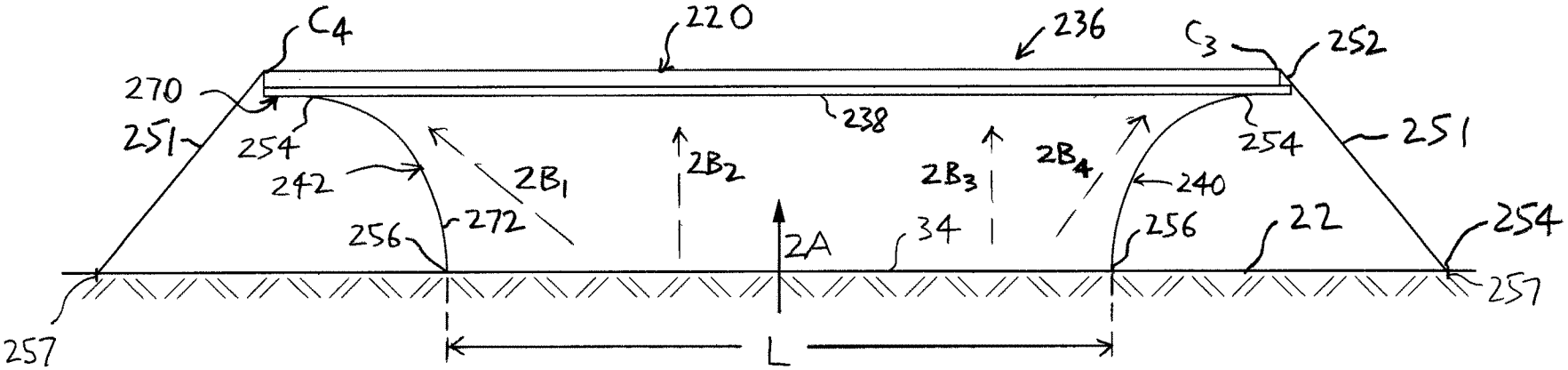
FIG. 5A is a side view of the mat assembly of FIGS. 4A-4C in which the mat body is raised off the preselected area and the skirt element is in an expanded condition.
Figure 5B:
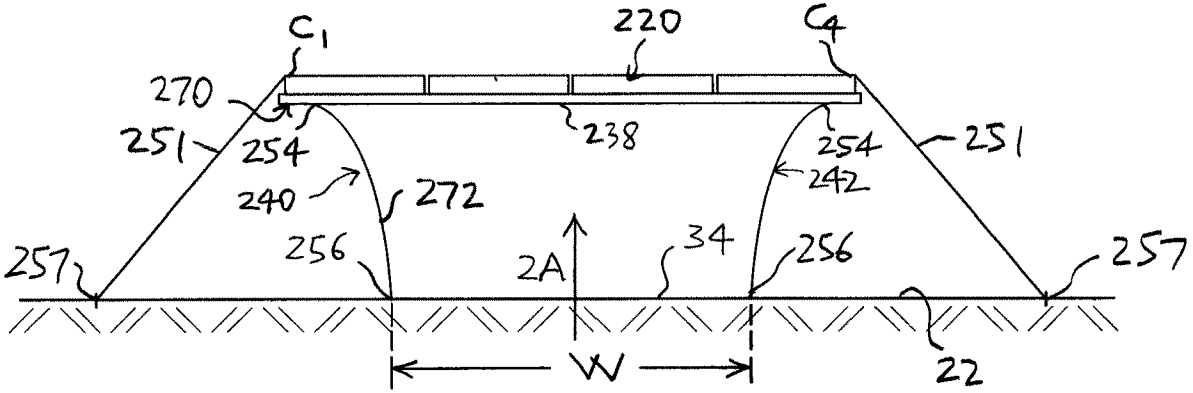
FIG. 5B is another side view of the mat assembly of FIG. 5A.
Figure 5C:
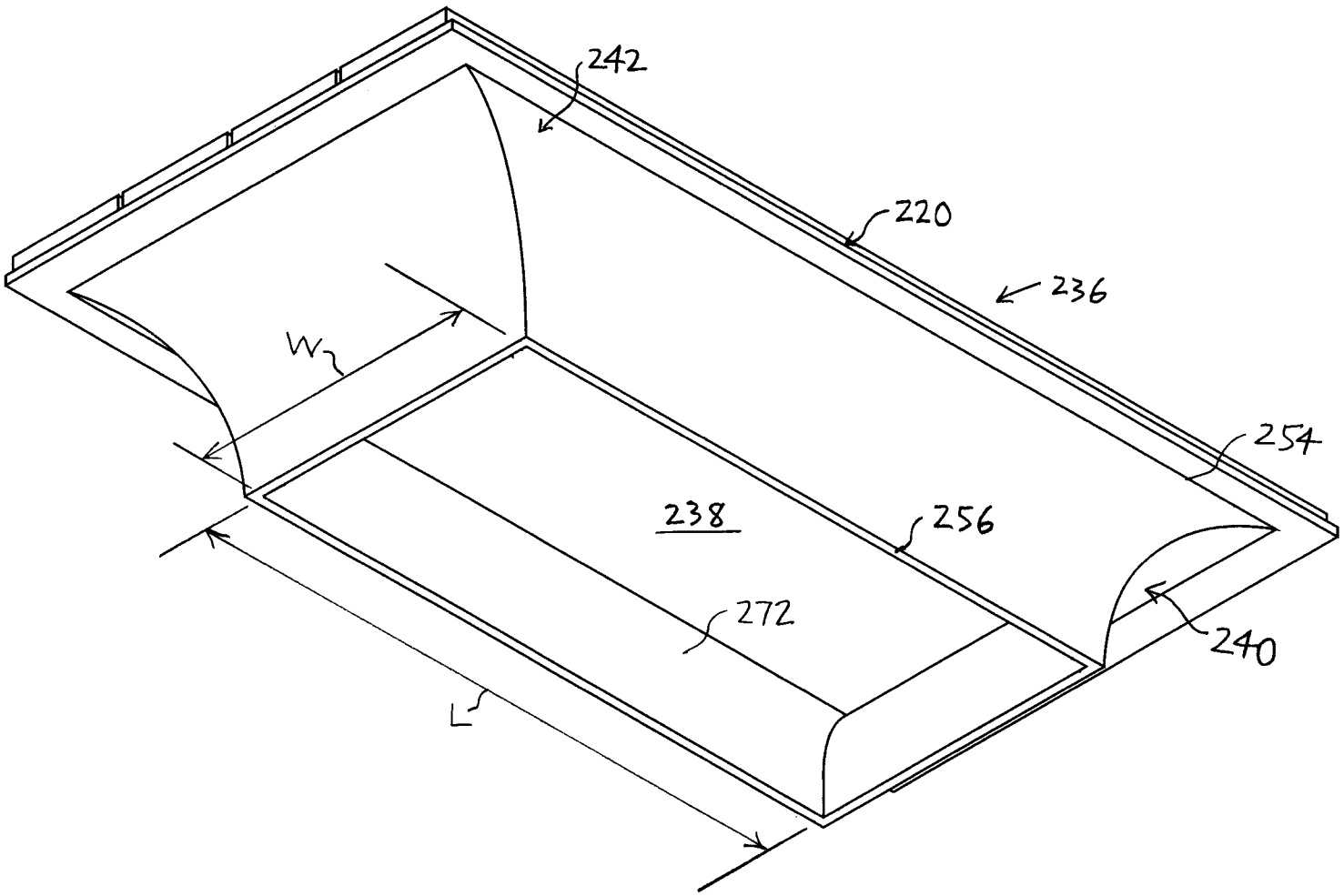
FIG. 5C is an isometric view of the mat assembly of FIGS. 5A and 5B.

Another embodiment of the mat assembly 236 of the invention is illustrated in FIGS. 4A-5C. As will be described, in FIGS. 4A-4C, the mat assembly 236 is shown in position over the preselected area 34, before the explosion is initiated. In contrast, FIGS. 5A-5C are intended to show the mat assembly 236 immediately after the explosion, when the ejected matter has pushed the mat body 220 to its position furthest away from the preselected area. It will be understood that the extent of movement of the mat assembly 236 upwardly (away from the surface region 22 immediately after the explosion), as illustrated in FIGS. 5A-5C, is exaggerated for clarity of illustration.

Preferably, the mat assembly 236 is formed to position the mat body 220 thereof relative to the preselected area 34 of the surface region 22. As described above in connection with other embodiments, the preselected area 34 partially defines the volume of ground to be broken by explosion therein. However, the mat body 220 preferably is larger than the preselected area 34. The preselected area 34 may be rectangular in plan view, having sides "L" and "W" (FIGS. 4A, 4B). The blastholes "BH" in the preselected area 34 can be seen in FIG. 4C. The mat body 220 includes one or more layer elements 224.

It will be understood that the mat body 220 as illustrated in FIGS. 4A-5C includes two layer elements, which are identified for convenience in FIG. 4B by reference characters 224A, 224B.

It is also preferred that the mat assembly 236 includes a skirt element 240 connected with the mat body 220. As can be seen in FIGS. 4A and 4B, the skirt element 240 preferably includes an external portion 242 extending from the mat body 220.

As can be seen in FIGS. 4A-5C, the mat assembly preferably also includes one or more anchor elements 251, for engaging a predetermined part of the mat body 220 to a preselected location on the surface region 22 relative to the preselected area 34.

The mat body 220 and the external portion 242 are configured to at least partially restrain matter that is ejected from the volume of ground, upon initiation of the explosion.

As can be seen in FIG. 5A, the external portion 242 preferably is positioned over the preselected area 34. The anchor elements 251 have inner ends 252 that are secured to corners "$C_1$"-"$C_4$" of the mat body 220 respectively (FIG. 4C). As can be seen n FIGS. 4A-4C, the anchor elements 251 preferably also include outer ends 254 that are secured to the surface region 22. As noted above, the anchor elements 251 preferably secure the mat body 220 in a preselected location relative to the preselected area 34. Preferably, the mat body 220 is located so that an outer edge 256 of the external portion 242 is substantially congruent or aligned with the outer perimeter of the preselected area 34.

The outer ends 254 may be secured to the surface region 22 in any suitable manner. For instance, holes (not shown) may be drilled into the surface region 22, and pegs 257 attached to the outer ends 254 respectively may be lodged in the holes.

In FIGS. 5A-5C, the mat assembly 236 is illustrated immediately following initiation of the explosion. As noted above, the extent of movement of the mat body 220 from the surface region due to the explosion has been exaggerated in these views, for clarity of illustration. It can be seen in FIGS. 5A and 5B that, immediately following the explosion, the external portion 242 is extended between an inner edge 254 thereof that is secured to the mat body 220 and the outer edge 256, which is located around the perimeter of the preselected area 34. It will be understood that the preselected area 34 may have any shape, e.g., rectangular. For example, in FIG. 5A, the preselected area 34 has a length "L", and in FIG. 5B, the preselected area 34 has a width "W".

As illustrated in FIGS. 5A and 5B, the mat body 220 may be moved upwardly, i.e., in the direction indicated by arrow "2A", by matter (e.g., gases, dust and debris, and flyrock) ejected from the volume of ground upon initiation of the explosion. Such upward movement, which is brief, is limited by the anchor elements 251. The movement of the ejected matter is schematically represented by arrows "$2B_1$"-"$2B_4$" in FIG. 5A. When the mat body 220 is pushed upwardly, the anchor elements 250 hold the mat body 220 in position, or substantially in position, over the preselected area 34. Those skilled in the art would appreciate that the upward movement (if any) is very brief, and the mat body subsequently falls down under the influence of gravity.

In FIGS. 5A and 5B, it can be seen that an inner portion 238 of a lower side 270 of the mat body 220 is located within the skirt element 240. The matter ejected from the volume of ground that is blasted is directed toward the inner portion 238 and an inner side 272 of the external portion 242.

Figure 6A:
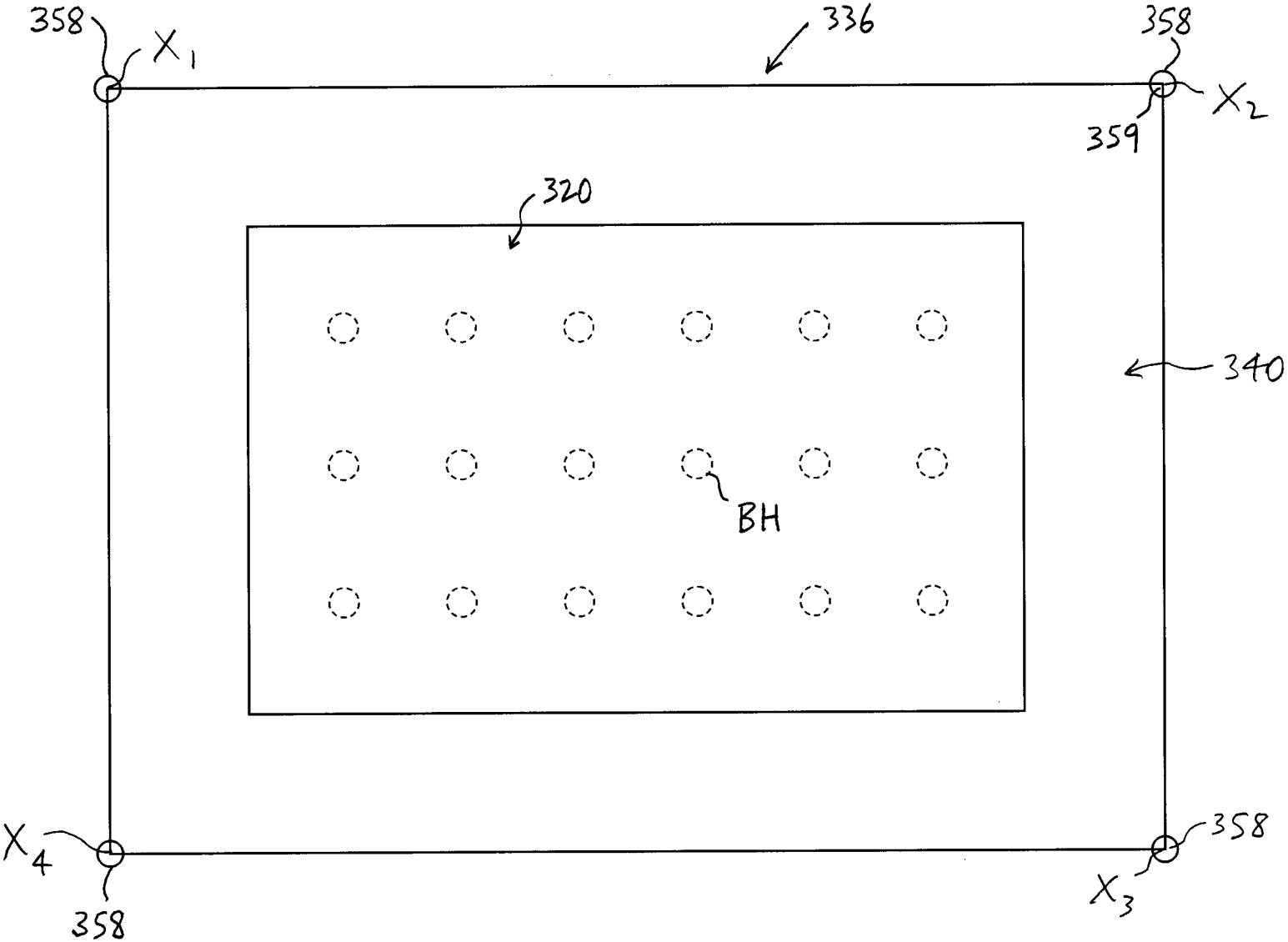
FIG. 6A is a top view of another embodiment of the mat assembly of the invention including an embodiment of the mat body of the invention, positioned on the preselected area of the surface region.
Figure 6B:
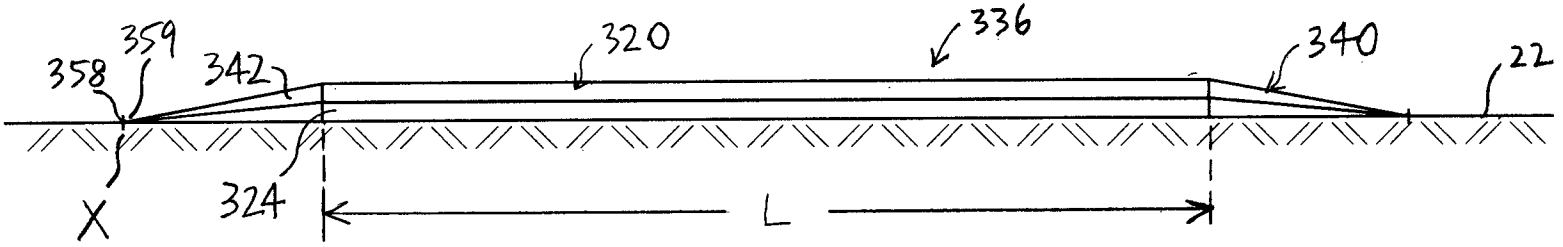
FIG. 6B is a side view of the mat assembly of FIG. 6A, positioned on the preselected area.
Figure 6C:
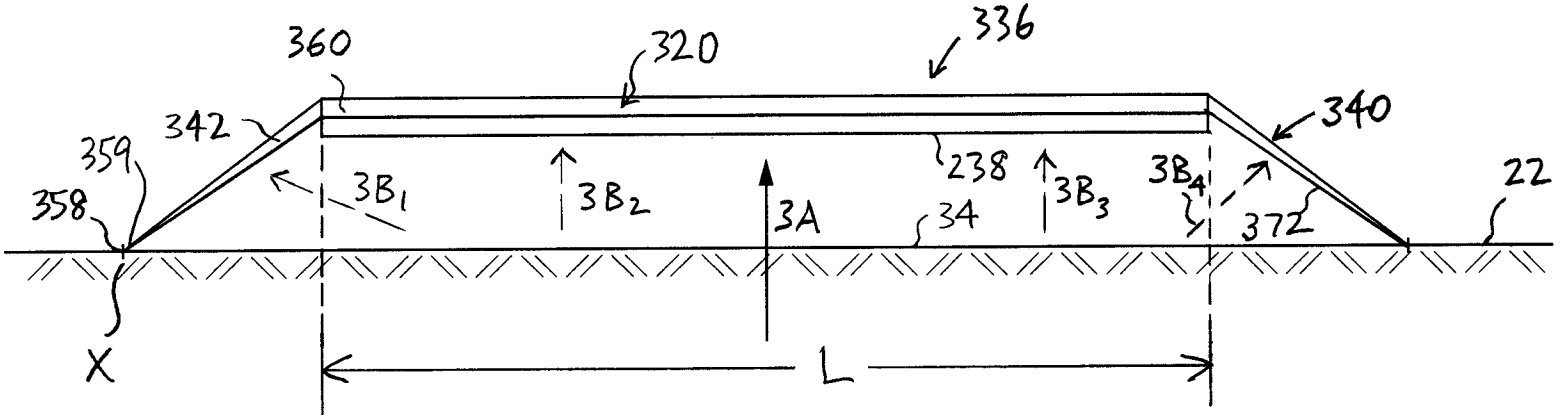
FIG. 6C is a side view of the mat assembly of FIGS. 6A and 6B in which the mat body is raised off the preselected area.

Another alternative embodiment of the mat assembly 336 of the invention is illustrated in FIGS. 6A-6C. The mat assembly 336 is formed to be positioned relative to the preselected area 34 of the surface region 22. As noted above, the preselected area 34 partially defines the volume of ground to be broken by explosion therein. The blastholes "BH" drilled in the preselected area 34 can be seen in FIG. 6A. In one embodiment, the mat assembly 336 preferably includes a planar mat body 320 formed to cover the preselected area 34. It is preferred that the mat body 320 includes one or more layer elements 324 (FIGS. 6B, 6C).

Preferably, the mat assembly 336 also includes a skirt element 340 connected with the mat body 320 (FIGS. 6B, 6C). As can be seen in FIGS. 6B and 6C, the skirt element 340 preferably includes an external portion 342 extending from the mat body 320, and the external portion 342 is located at least partially transverse to the mat body 320.

In one embodiment, the mat assembly 336 preferably also includes one or more anchor devices 358, for engaging a predetermined part 359 of the external portion to the surface region 22 at preselected locations "$X_1$"-"$X_4$" (FIG. 6A) on the surface region 22 relative to the preselected area 34.

The mat body 320 and the external portion 342 preferably are configured to at least partially restrain matter that is ejected from the volume of ground upon initiation of the explosion.

In FIG. 6B, the mat assembly 336 is shown prior to initiation of the explosion, and in FIG. 6C, the mat assembly 336 is shown immediately following the explosion. Such upward movement of the mat body 320 is limited by the anchor devices 358. Upon detonation of the low-velocity explosive in the blastholes "BH", the mat body 320 briefly moves upwardly due to the matter ejected by the explosion, and the external portion 342 is, at that time, briefly pulled taut.

It will be understood that the position of the mat body 320 relative to the preselected area 34, as illustrated in FIG. 6C, is exaggerated for clarity of illustration. Those skilled in the art would appreciate that, in practice, there is little upward movement of the mat body 320 immediately following the explosion of a low-velocity explosive (due to the matter ejected upon such explosion). Immediately following any upward movement, the mat body 320 would fall mostly onto the preselected area 34, due to gravity.

The upward movement of the mat body 320 immediately following the explosion is indicated in FIG. 6C by arrow "3A". The matter ejected from the volume of rock immediately following the explosion is schematically represented by arrows "$3B_1$"-"$3B_4$" in FIG. 6C. As can be seen in FIG. 6C, the mat body 320 preferably includes an engagement surface 338, and the external portion 342 includes an inner side 372 thereof. Those skilled in the art would appreciate that the matter (e.g., gases, dust and debris, and flyrock) ejected from the volume of the ground immediately after the blast is initiated engages the engagement surface 338 and the inner side 372.

It will be understood that the mat assembly 336 is not intended to restrain all of the matter that is ejected from the volume of ground that is blasted. It is preferred that minor amounts of dust and gases that are ejected may be allowed to escape from underneath the mat assembly into the ambient atmosphere. Those skilled in the art would appreciate that allowing some of the gases to escape from underneath the mat assembly 336 would reduce the stresses to which the mat assembly 336 is subjected immediately following the explosion.

In one embodiment, the mat body 320 preferably includes a number of layer elements 324, and the layer elements 324 are arranged in a number of layers. For example, the mat body 320 as illustrated includes two layer elements, 324A, 324B (FIG. 6B).

It is also preferred that the layer elements 324 in respective adjacent layers are secured to each other.

As noted above, the skirt element 340 may be formed so that part of it may be included in the mat body 320. For example, the skirt element 340 may include a layer element portion 360 that is one of the layer elements 324, as well as the external portion 342.

Also as noted above, the mat body 320 may have an area density up to 2.2 pounds per square foot.

The predetermined part 359 of the external portion 342 that is secured to the surface region 22 is distal to the mat body 320. As can be seen in FIG. 6A, in one embodiment, the predetermined part 359 preferably is secured to the surface region 22 only at the four locations (identified as "$X_1$"-"$X_4$" in FIG. 6A). It is believed that this arrangement permits some of the gases released by the explosion to escape from beneath the mat assembly, along the outer edge of the skirt element 240 at locations between the predetermined locations "$X_1$"-"$X_4$". This is thought to be necessary in order to minimize the stresses to which the mat assembly 336 is subjected, immediately following the explosion.

In use, the mat body 20 illustrated in FIGS. 1A-1E preferably is positioned on the preselected area 34 of the surface region 22, as shown in FIG. 1B. The sides of the mat body 20 may be congruent with the preselected area 34. The blast pattern is drilled in the preselected area 34. It will be understood that the blastholes "BH" are shown in FIG. 1B in order to show that the mat body 20 is positioned on the blast pattern. Those skilled in the art would appreciate that, after the low-velocity explosive charges are loaded into the blastholes "BH", the mat body 20 is positioned on the preselected area 34, i.e., over the blast pattern. When the low velocity explosives are detonated, the matter (gases, dust and debris, and flyrock) that is ejected from the volume of rock partially defined by the preselected area is at least partially restrained by the mat body 20. As noted above, it is preferred that the lower side of the mat body 20, which at least partially engages the preselected area, is formed to be generally abrasion-resistant.

Similarly, in use, the mat assembly 136 is positioned so that the mat body 120 is over the preselected area (FIGS. 2A, 2B). As can be seen in FIG. 2C, in which the blastholes "BH" are shown, the mat body 120 preferably is positioned over the blast pattern. When the low-velocity explosives in the blastholes "BH" are detonated, the matter ejected from the volume of rock partially defined by the preselected area 34 is partially restrained by the mat body 120 and the external portion 142.

As can be seen in FIG. 3, in another embodiment of the method of the invention, the mat assembly 136 may be positioned so that the opposite side 150 of the mat body 120 engages the preselected area 34, and the upper side 148 of the external portion 142 engages an area of the surface region 22 that surrounds the preselected area 34. Upon initiation of the explosion, the matter ejected from the volume of rock partially defined by the preselected area 34 is partially restrained by the mat body 120 and the external portion 142.

In another embodiment, illustrated in FIGS. 4A-5C, the mat assembly 236 preferably is positioned over the preselected area 34. As can be seen in FIGS. 5A and 5B, the outer edge 256 of the external portion 242 preferably is located around the perimeter of the preselected area 34. The mat body 220 is held in place by anchor elements 251, which connect predetermined parts of the mat body 220 with the surface region 22 (FIG. 4C). The mat body 220 covers the preselected area 34, in which the blastholes "BH" are drilled.

As can be seen in FIGS. 5A and 5B, when the explosion is initiated, the mat body 220 is moved upwardly, although its upward movement is limited by the anchor elements 251. When the mat body 220, the external portion 242 of the skirt element 240 is briefly extended (FIGS. 5A, 5B). The matter ejected from the volume of the ground by the explosion is at least partially restrained by the mat body 220 and the external portion 242.

In another embodiment of the method of the invention, the mat body 320 is positioned on the preselected area 34, and the predetermined part 359 of the external portion 342 of the skirt element 340 is secured to the surface region 22 at predetermined locations, so that the mat body 320 is positioned to cover the preselected area 34 and the blastholes "BH" drilled therein. As can be seen in FIG. 6A, for example, the external portion 342 is secured to the surface region 22 by at locations identified for convenience by reference characters "$X_1$"-"$X_4$". The matter ejected from the volume of the ground by the explosion is at least partially restrained by the mat body 320 and the external portion 342.

The mat body 20, and the mat assemblies 136, 236, 336, preferably only partially restrain the dust and gases that are ejected from the volume of rock upon detonation of the low velocity explosives. It is also believed that the escape of a small amount of the dust and gases from underneath the mat body 20 and the mat assemblies 136, 236, 336 is preferable, because such escape would limit the stresses to which the mat body 20 and the mat assemblies 136, 236, 336 might otherwise be subjected.

It will be understood that the mat body included in each of the mat assemblies 136, 236, and 336 preferably is the mat body 20 described above. As noted above, the mat body preferably had an area density of 2.2 pounds per square foot or less. The mat body preferably is sufficiently flexible that it can be rolled into a relatively small cylinder, to minimize shipping costs.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

I claim:

1. A mat assembly formed to be positioned relative to a preselected area of a surface region of ground, the preselected area partially defining a volume of the ground to be broken by explosion therein, the mat assembly comprising:

a planar mat body formed to cover a predetermined area larger than a preselected area, the predetermined area including the preselected area, the mat body being positionable on the predetermined area to locate a lower side thereof facing the surface region;

a skirt element connected at an inner edge thereof to the mat body to define an inner portion of the lower side, the skirt element comprising an external portion extendable from the mat body;

the external portion additionally comprising an outer edge thereof that is positionable on the surface region for alignment of the outer edge with a perimeter of the preselected area;

at least one anchor element, for securing the mat body to a preselected location on the surface region to cover the predetermined area, to limit upward movement of the mat body due to the explosion, wherein, upon initiation of the explosion, the mat body is thereby pushed upwardly, and the upward movement of the mat body extends the external portion to position an inner side of the external portion and the inner portion of the mat body for at least partially restraining matter that is ejected from the volume of ground by the explosion.

2. A mat assembly formed to be positioned relative to a preselected area of a surface region of ground, the preselected area partially defining a volume of the ground to be broken by explosion therein, the mat assembly comprising:

a planar mat body formed to cover a predetermined area larger than the preselected area, the predetermined area including the preselected area, the mat body being positionable on the predetermined area to locate a lower side thereof facing the surface region;

the mat body having an area density up to 2.2 pounds per square foot;

a skirt element connected at an inner edge thereof with the mat body to define an inner portion of the lower side, the skirt element comprising an external portion extendable from the mat body;

the external portion additionally comprising an outer edge thereof that is positionable on the surface region for alignment of the outer edge with a perimeter of the preselected area; and at least one anchor element, for securing the mat body to a preselected location on the surface region to cover the predetermined area, to limit upward movement of the mat body due to the explosion, wherein the mat body is moved upwardly by the explosion and extends the external portion to position an inner side of the external portion and the inner portion of the mat body for at least partially restraining matter that is ejected from the volume of ground, upon initiation of the explosion.

3. A method of at least partially restraining matter ejected from a volume of ground upon the volume of ground being broken by explosion therein, the volume of ground being partially defined by a preselected area of a surface region of the ground, the method comprising:

(a) providing a mat assembly comprising:

a planar mat body formed to cover a predetermined area larger than the preselected area that includes the preselected area;

the mat body having a lower side thereof;

a skirt element connected with the mat body, the skirt element comprising an external portion extendable from the mat body;

the external portion comprising an inner edge secured to the mat body to define an inner portion of the lower side, and an outer edge that is positionable for alignment with a perimeter of the preselected area;

(b) positioning the mat body on the predetermined area, with the lower side facing downwardly, to locate the inner portion on the preselected area; and (c) upon initiation of the explosion, permitting the mat body to be moved upwardly by the explosion, the upward movement of the mat body extending the external portion to position an inner side of the external portion and the inner portion of the mat body for at least partially restraining the matter ejected from the volume of the ground by the explosion.

* * * * *